US007468584B2

(12) United States Patent
Tsukamoto et al.

(10) Patent No.: US 7,468,584 B2
(45) Date of Patent: Dec. 23, 2008

(54) DISCHARGE LAMP WITH A DISCHARGE FILLING HAVING A MEASURED EMISSION INTENSITY OF ARGON TO OH RADICALS AND METHOD OF MANUFACTURING THE SAME

(75) Inventors: Takuya Tsukamoto, Himeji (JP); Noriko Nishiaki, Himeji (JP); Yoshihiro Horikawa, Himeji (JP); Senga Takehito, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 436 days.

(21) Appl. No.: 11/391,307

(22) Filed: Mar. 29, 2006

(65) Prior Publication Data

US 2006/0220562 A1 Oct. 5, 2006

(30) Foreign Application Priority Data

Mar. 31, 2005 (JP) ..... 2005-102248

(51) Int. Cl.

| | |
|---|---|
| ***H01J 9/00*** | (2006.01) |
| ***H01J 9/42*** | (2006.01) |
| ***H01J 61/12*** | (2006.01) |
| ***H01J 61/16*** | (2006.01) |

(52) U.S. Cl. ..... 313/637; 313/640; 313/642; 313/643; 445/53; 445/3; 445/16

(58) Field of Classification Search ..... 445/3, 445/16, 26, 53; 313/637–643
See application file for complete search history.

(56) References Cited

U.S. PATENT DOCUMENTS

| | | | |
|---|---|---|---|
| 5,109,181 | A | 4/1992 | Fischer et al. |
| 6,271,628 | B1 | 8/2001 | Sugitani et al. |
| 6,368,175 | B1 | 4/2002 | Horiuchi et al. |
| 2004/0090183 | A1 | 5/2004 | Kawaguchi et al. |
| 2004/0189208 | A1 | 9/2004 | Kurimoto et al. |

FOREIGN PATENT DOCUMENTS

| | | | |
|---|---|---|---|
| JP | 2002-75269 | A | 3/2002 |

*Primary Examiner*—Mariceli Santiago
(74) *Attorney, Agent, or Firm*—David S. Safran; Roberts Mlotkowski Safran & Cole, P.C.

(57) ABSTRACT

Process for producing a discharge lamp having a silica discharge vessel with an emission space in which there is a pair of electrodes at least 0.15 mg/mm$^3$ of mercury, argon (Ar), and halogen by measuring the relation b/a1 between the emission intensity a1 of argon (Ar) at a wavelength of 668 nm and the emission intensity b of OH radicals at a wavelength of 309 nm in a state of glow discharge of the discharge lamp; supplying hydrogen into the discharge vessel of the discharge lamp; measuring the relation c/a2 between the emission intensity a2 of argon (Ar) at a wavelength of 668 nm and the emission intensity c of OH radicals at a wavelength of 309 nm in the state of glow discharge of the discharge lamp; and fixing the difference c/a2−b/a1 at a value in the range of 0.001 to 15.

7 Claims, 7 Drawing Sheets

Fig. 4 (a)
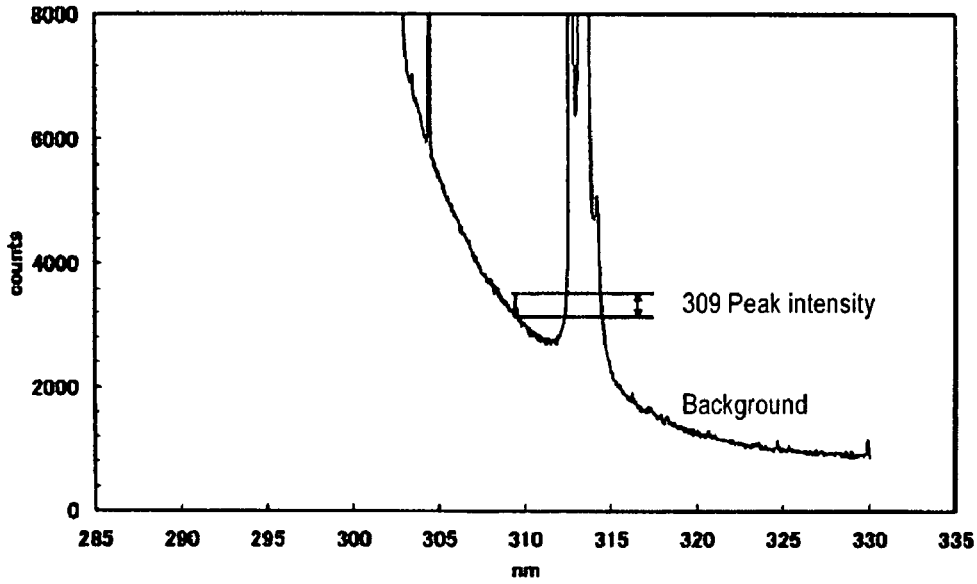
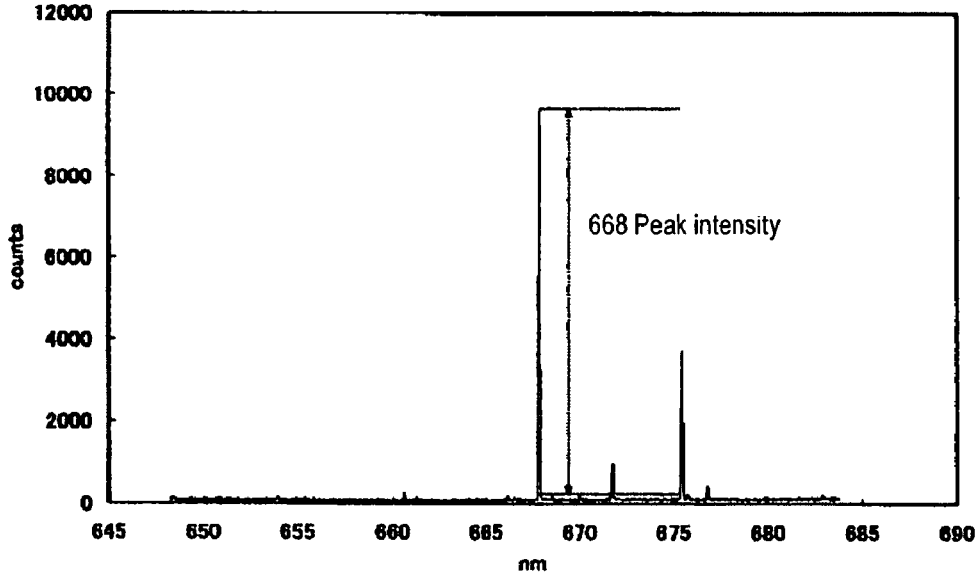
Fig. 4 (b)

Fig. 5 (a)
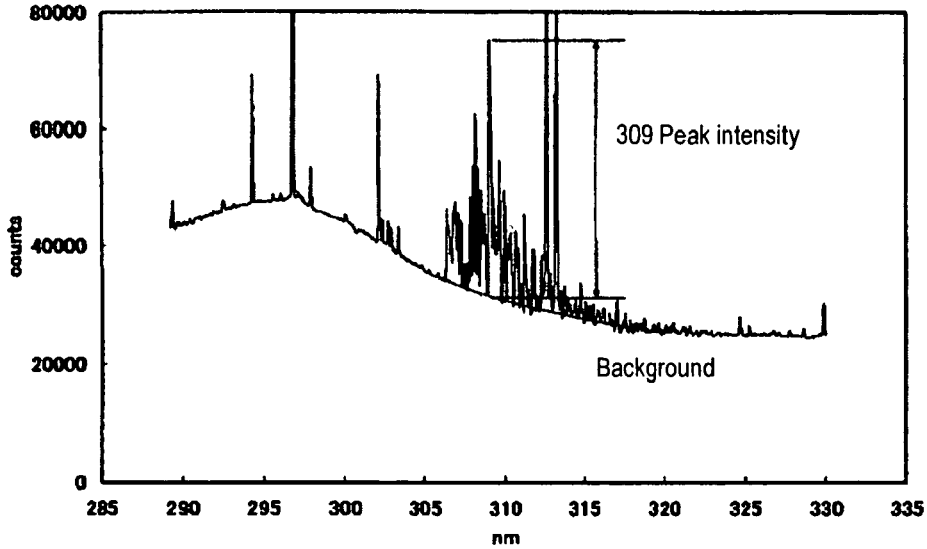
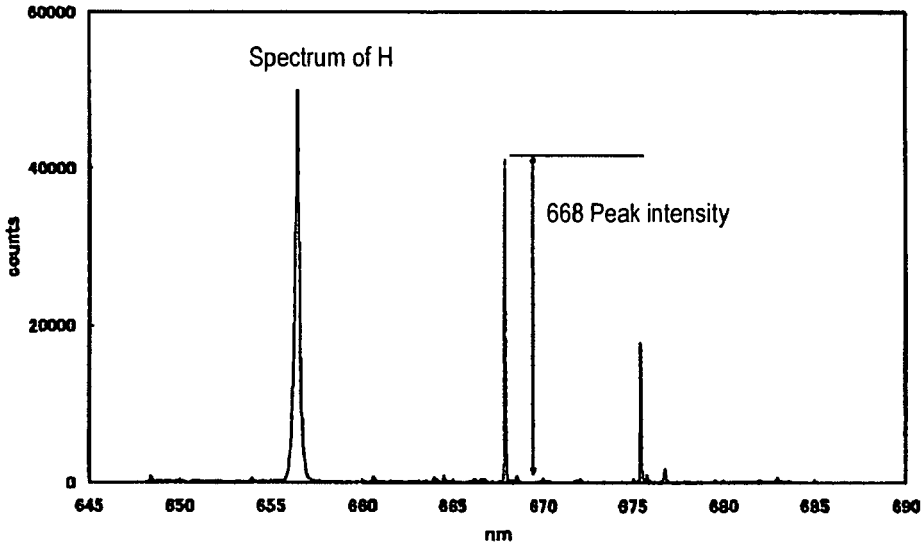
Fig. 5 (b)

Fig. 6 (a)
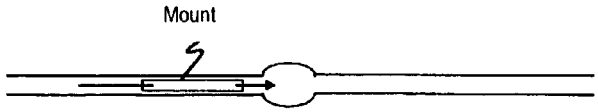
Sealing of one side
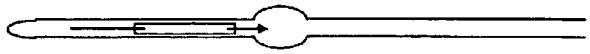
Fig. 6 (b)
Filling with emission substance
Fig. 6 (c)
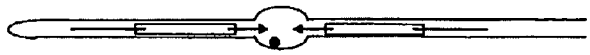
Evacuation
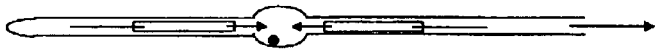
Fig. 6 (d)
Filling with Ar – $O_2$
Fig. 6 (e)
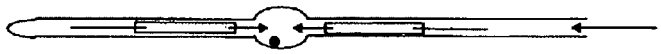
Sealing of other side
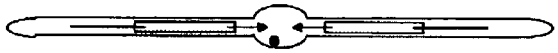
Fig. 6 (f)
Preparation of one hermetically sealed part
Fig. 6 (g)
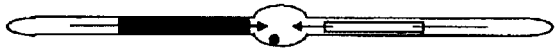
Preparation of other hermetically sealed part
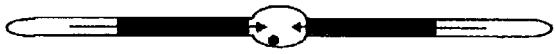
Fig. 6 (h)

Fig. 7

| | b/a1 | c/a2 | c/a2 – b/a1 | Lighting Time (h) | | | | | | | | Evaluation |
|---|---|---|---|---|---|---|---|---|---|---|---|---|
| | | | | 0 | 100 | 300 | 500 | 1000 | 3000 | 5000 | 10000 | |
| Lamp 1 | 0.0065 | 0.0066 | 0.0001 | 100 | 78 | 67 | 69 | 53 | 43 | 49 | 31 | × |
| Lamp 2 | 0.0268 | 0.0273 | 0.0005 | 100 | 75 | 67 | 54 | 52 | 48 | 45 | 37 | × |
| Lamp 3 | 0.0347 | 0.0350 | 0.0003 | 100 | 97 | 61 | 68 | 58 | 40 | 41 | 30 | × |
| Lamp 4 | 0.0253 | 0.0263 | 0.0010 | 100 | 93 | 95 | 93 | 90 | 97 | 84 | 74 | ○ |
| Lamp 5 | 0.0263 | 0.0303 | 0.0040 | 100 | 94 | 91 | 91 | 91 | 95 | 93 | 85 | ○ |
| Lamp 6 | 0.0435 | 0.0460 | 0.0025 | 100 | 90 | 97 | 94 | 93 | 87 | 96 | 80 | ○ |
| Lamp 7 | 0.0069 | 0.0369 | 0.0300 | 100 | 94 | 95 | 93 | 97 | 85 | 94 | 90 | ○ |
| Lamp 8 | 0.0447 | 0.1127 | 0.0680 | 100 | 99 | 95 | 91 | 96 | 80 | 91 | 75 | ○ |
| Lamp 9 | 0.0474 | 0.1314 | 0.0840 | 100 | 92 | 98 | 99 | 97 | 98 | 89 | 98 | ○ |
| Lamp 10 | 0.0185 | 0.5385 | 0.5200 | 100 | 93 | 95 | 91 | 97 | 86 | 81 | 98 | ○ |
| Lamp 11 | 0.0073 | 0.9873 | 0.9800 | 100 | 96 | 98 | 97 | 91 | 90 | 95 | 75 | ○ |
| Lamp 12 | 0.0459 | 0.9289 | 0.8830 | 100 | 99 | 94 | 91 | 97 | 93 | 95 | 89 | ○ |
| Lamp 13 | 0.0042 | 6.5392 | 6.5350 | 100 | 92 | 99 | 95 | 91 | 87 | 96 | 93 | ○ |
| Lamp 14 | 0.0298 | 1.9895 | 1.9597 | 100 | 97 | 100 | 97 | 95 | 91 | 90 | 90 | ○ |
| Lamp 15 | 0.0166 | 4.6754 | 4.6588 | 100 | 93 | 96 | 90 | 91 | 85 | 99 | 70 | ○ |
| Lamp 16 | 0.0103 | 13.3874 | 13.3771 | 100 | 94 | 93 | 91 | 94 | 90 | 86 | 71 | ○ |
| Lamp 17 | 0.0500 | 12.4923 | 12.4423 | 100 | 93 | 95 | 100 | 82 | 88 | 92 | 74 | ○ |
| Lamp 18 | 0.0015 | 15.0025 | 15.0010 | 100 | 99 | 98 | 98 | 99 | 99 | 71 | 98 | ○ |
| Lamp 19 | 0.0344 | 20.0998 | 20.0654 | 100 | 92 | 65 | 55 | 54 | – | – | – | × |
| Lamp 20 | 0.0208 | 27.2317 | 27.2109 | 100 | 80 | 68 | 64 | – | – | – | – | × |
| Lamp 21 | 0.0167 | 19.7844 | 19.7677 | 100 | 83 | 70 | – | – | – | – | – | × |
| Lamp 22 | 0.0542 | 0.1515 | 0.0973 | 100 | 72 | 62 | 65 | 60 | 64 | 60 | 51 | × |
| Lamp 23 | 0.0887 | 0.7526 | 0.6638 | 100 | 70 | 60 | 62 | 64 | 61 | 59 | 51 | × |
| Lamp 24 | 0.5515 | 1.3645 | 0.8130 | 100 | 75 | 65 | 68 | 63 | 60 | 56 | 53 | × |

DISCHARGE LAMP WITH A DISCHARGE FILLING HAVING A MEASURED EMISSION INTENSITY OF ARGON TO OH RADICALS AND METHOD OF MANUFACTURING THE SAME

BACKGROUND OF THE INVENTION

1. Field of the Invention

The invention relates to a discharge lamp, especially to a discharge lamp filled with at least 0.15 mg/mm$^3$ of mercury, argon (Ar) and halogen.

2. Description of the Prior Art

A super-high pressure mercury lamp is used as a light source for a projector. In this mercury lamp, generally, there is a pair of opposed electrodes at a distance of roughly 2 mm from one another in a silica glass arc tube which has an emission space that is filled with at least 0.15 mg/mm$^3$ of mercury, a rare gas with argon as the main component, and halogen. This lamp is disclosed, for example, in Japanese Patent Nos. 2829339 and 2980882 (which correspond to U.S. Pat. Nos. 5,109,181 and 6,271,628) and the like. These discharge lamps are used for a liquid crystal cell device, a projector device using a DMD (digital micro mirror device), such as DLP (digital light processor) or the like, and a rear projection television.

The main purpose of adding halogen is to prevent devitrification of the arc tube. However, in this way, both the function of a so-called halogen cycle and also the action of prolonging the service life are obtained.

So that the halogen cycle works well, a suitable amount of halogen must be added. However, it is known that a suitable amount of oxygen is added, because in the case of an overly small or large amount of oxygen, the disadvantage of blackening of the inside surface of the arc tube or wear of the tungsten electrodes occurs. For example, it is described in Japanese Patent Application Publication 2004-303573 (U.S. Patent Application Publication 2004/0189208 A1) that a given amount of oxygen should be added with respect to the amount of halogen added.

Generally, the process for determining the substance contained in the emission space of the discharge lamp is a process in which spectra are measured, in which, therefore, based on the intensity of the line spectrum of a certain substance, the amount of the latter which has been added is measured. In the case of oxygen, this metering takes place based on the intensity of the line spectrum of the OH radicals.

In a discharge lamp which contains a large amount of mercury, such as a mercury lamp, especially a discharge lamp for a projector device, emission by mercury is, however, too strong, so that it is not possible to measure the line spectrum of the OH radicals. Therefore, the process for measuring a substance contained in a discharge lamp based on its spectrum for rated operation (arc discharge emission) is difficult in the case of a mercury lamp.

Furthermore, there is also a process in which the discharge lamp is subjected to a glow discharge and the substance (filler) is metered because the line spectrum of the OH radicals can be measured since the emission by mercury is not strong. This technique is described, for example, in Japanese Patent Application Publication Nos. 2002-75269 A and 2004-8204 A (the latter corresponding to U.S. Patent Application Publication 2004/0090183 A1). In this connection, OH radicals and other substances, such as argon and the like, are metered based on the respective ratio of the spectral intensity. In particular, in Japanese Patent Application Publication 2004-158204 A and corresponding U.S. Patent Application Publication 2004/0090183 A1, the ratio of the emission intensity of OH radicals to argon and the ratio of the emission intensity of hydrogen to argon are measured and the emission spectra of OH radicals and hydrogen with respect to argon are determined.

The reason for using the spectrum of OH radicals to determine the oxygen is the following:

Oxygen atoms (O) and oxygen molecules ($O_2$) often react with other substances. Measurement of the line spectrum of oxygen atoms (O) and of oxygen molecules ($O_2$) is difficult. In practice, OH radicals are formed by dissociation from water molecules ($H_2O$), which have been produced for their part by a reaction of oxygen with hydrogen. The emission intensity is proportional to the number of water molecules ($H_2O$).

However, here, a new disadvantage has arisen. The above described analysis process, based on a glow discharge, is a process in which the gas portion in the gaseous phase is measured at a relatively low temperature.

In general, in a discharge lamp, during operation, a certain amount of oxygen in the form of compounds with tungsten and bromine are present in the gaseous state and are used for the halogen cycle. When the lamp is turned off and the temperature drops, these oxygen compounds, in bound form, are converted into a solid aggregate state and are deposited on the inside wall of the arc tube and the like. Specifically, they are present as tungsten oxide ($WO_x$) and tungsten bromoxide ($WO_xBr_y$).

The oxygen present in the emission space during rated operation (arc discharge emission) as a compound of tungsten and bromine in the state of a gaseous phase contributes to the halogen cycle. However, in a glow discharge emission in the low temperature state, it is not sufficiently present in the gaseous phase, but is generally present as a compound, therefore in the solid aggregate state.

Therefore, in the process for determining the OH radicals by a conventional glow discharge, only part of the oxygen which is randomly present in the gaseous phase state is measured and oxygen in the solid aggregate state is not measured, in other words, not the oxygen which is actually to be measured. As a result, in conventional analysis processes by glow discharge emission, exact metering of the oxygen which is intended to contribute to the halogen cycle does not take place.

Of course, it can also be imagined that a process can be used in such a manner that a given amount of oxygen is reliably added in production. The reason for this is the following:

When the oxygen has been exactly added according to the design, the amount of oxygen can be fixed at a certain range even if the discharge lamp cannot be quite exactly established as a finished part.

This idea may be theoretically correct. The oxygen to be added to the discharge lamp is, however, closely connected to the production process with respect to heat treatment conditions of the material components, the atmosphere and the like. Therefore, agreement of the set point with the actual amount added is not possible.

Specifically, dissolved water or absorption water is deposited on the tungsten electrodes and the molybdenum metal foils. Furthermore, in the process of sealing the hermetically sealed portions, silica glass can vaporize and the oxygen component can penetrate into the emission space. This means that, in the production process, oxygen is present which cannot be controlled and which inevitably penetrates.

In the discharge lamp which is used for a projector device, the arc tube has an extremely small inside volume of at most roughly 100 $mm^3$. Even for a small difference in the amount of oxygen, the function and action of the halogen cycle change greatly.

Furthermore, it can be imagined that, in the completed discharge lamp, the amount of oxygen will be measured by a destructive process. However, at the instant of destruction oxygen inevitably penetrates from the outside.

As a result, control of the amount of oxygen in the production process and a process in which the discharge lamp is destroyed after production and the oxygen is measured, cannot be implemented in practice. Therefore, the amount of oxygen actually added to the discharge lamp must be measured by a nondestructive process.

In summary this means the following:

(1) In a discharge lamp to which halogen has been added, it is necessary to add oxygen in a certain range with respect to the amount of the halogen added in order to allow the halogen cycle to proceed effectively. In JP Patent Application Publication 2004-303573 A (corresponding to U.S. Patent Application Publication 2004/0189208 A1), the range of the amount of oxygen with respect to the amount of the halogen added is shown. However, how metering is carried out is not indicated here. Nor does this reference provide any exact determination of the correctly functioning amount of oxygen in rated operation.

(2) There is a process in which the amount of the emission substance added is measured based on the emission spectra. If the discharge lamp is subjected to an arc discharge, due to the strong emission of mercury, the spectra of other substances cannot be measured. As is shown in Japanese Patent Application Publication 2002-75269 A and Japanese Patent Application Publication 2004-158204 A (corresponding to U.S. Patent Application Publication 2004/0090183 A1), there is also a metering process based on a glow discharge. Since oxygen is shifted into a solid aggregate state, the oxygen which passes into the gaseous phase during rated operation cannot be exactly measured.

SUMMARY OF THE INVENTION

A primary object of the present invention is to devise a process for exact measurement of the amount of oxygen which is present in the emission space in the gaseous state during rated operation. A related object of the invention is, furthermore, to devise a discharge lamp with a suitable amount of oxygen as determined by such a process.

According to the invention, in a process for producing a discharge lamp in which there is a pair of electrodes in a silica glass discharge vessel and the discharge vessel is filled with at least 0.15 $mg/mm^3$ of mercury, argon (Ar), and halogen, the primary object is achieved by the following process steps:

the relation b/a1 between the emission intensity a1 of argon (Ar) at a wavelength of 668 nm and the emission intensity b of OH radicals at a wavelength of 309 nm is measured in the state of a glow discharge of the discharge lamp;

hydrogen is added to the discharge vessel of this discharge lamp;

the relation c/a2 between the emission intensity a2 of argon (Ar) at a wavelength of 668 nm and the emission intensity c of OH radicals at a wavelength of 309 nm is likewise measured in the state of a glow discharge of the discharge lamp; and the difference between b/a1 and c/a2, i.e. (c/a2−b/a1) is fixed within the range of from 0.001 to 15.

Furthermore, in accordance with the invention, in a discharge lamp in which there is, a pair of electrodes in a silica glass discharge vessel and the discharge vessel is filled with at least 0.15 $mg/mm^3$ of mercury, argon (Ar), and halogen, this object is achieved in that the difference between b/a1 and c/a , i.e., (c/a2−b/a1) is from 0.001 to 15, when the relation between the emission intensity a1 of argon (Ar) at a wavelength of 668 nm and the emission intensity b of OH radicals at a wavelength of 309 nm in the state of a glow discharge of the discharge lamp is b/a1 and the relation between the emission intensity a1 of argon (Ar) at a wavelength of 668 nm and the emission intensity c of OH radicals at a wavelength of 309 nm likewise in the state of a glow discharge of the discharge lamp after adding hydrogen to the discharge vessel of the discharge lamp is labelled c/a2.

Action of the Invention

According to the invention, the amount of oxygen which is present in the OFF state or for a glow discharge in the solid aggregate state, such as tungsten oxide ($WO_x$) or tungsten bromoxide ($WO_xBr_y$), can be determined by the above described arrangement and by adding exactly metered oxygen the halogen cycle can be allowed to proceed effectively and thus a discharge lamp with a long service life can be devised.

This means that it was found in the invention that the oxygen which, when the lamp has been turned off or in a glow discharge, is present in the form of a compound, such as tungsten oxide ($WO_x$) or tungsten bromoxide ($WO_xBr_y$), in the solid aggregate state is the oxygen which in fact supports the halogen cycle. Therefore, a production process in which the oxygen which is present in the form of a compound is metered is enabled and a discharge lamp filled with suitable amounts of oxygen have been devised.

One important feature of the invention comprises reducing the oxygen which is present in the form of a compound by supplying hydrogen to the discharge lamp, in converting the oxygen into the form of water molecules ($H_2O$) and in essentially measuring the total amount of oxygen present in the emission space.

Specifically, the emission intensity of OH radicals in the gaseous phase is measured by an analysis process in the state of a glow discharge (measurement result 1). Next, hydrogen is added to this discharge lamp and the emission intensity of OH radicals in the gaseous phase is measured, likewise, by an analysis process in the state of a glow discharge (measurement result 2). The emission intensity of the OH radicals determined for measurement result 2 comprises water molecules ($H_2O$) which were already in the gaseous state before adding the hydrogen, and the oxygen which was present as a compound of tungsten oxide ($WO_x$) or tungsten bromoxide ($WO_xBr_y$) before adding the hydrogen. By subtraction of (measurement result 2−measurement result 1), therefore, the oxygen is determined which was present as the compound of tungsten oxide ($WO_x$) or tungsten bromoxide ($WO_xBr_y$) before adding the hydrogen.

The invention is further described below using several embodiments which are shown in the accompanying drawings.

BRIEF DESCRIPTION OF THE DRAWINGS

FIGS. 4(*a*) & 4(*b*) each show a graph of an example of the spectrum of the discharge lamp in accordance with the invention before supplying of hydrogen;

FIGS. 5(*a*) & 5(*b*) each show a graph of an example of the spectrum of a discharge lamp as claimed in the invention after supplying of hydrogen;

FIGS. 6(*a*) to 6(*h*) each show a step in the process of producing a discharge lamp in accordance with the invention; and FIG. 7 is a table that shows the results of testing of the invention.

DETAILED DESCRIPTION OF THE INVENTION

Figure 1:
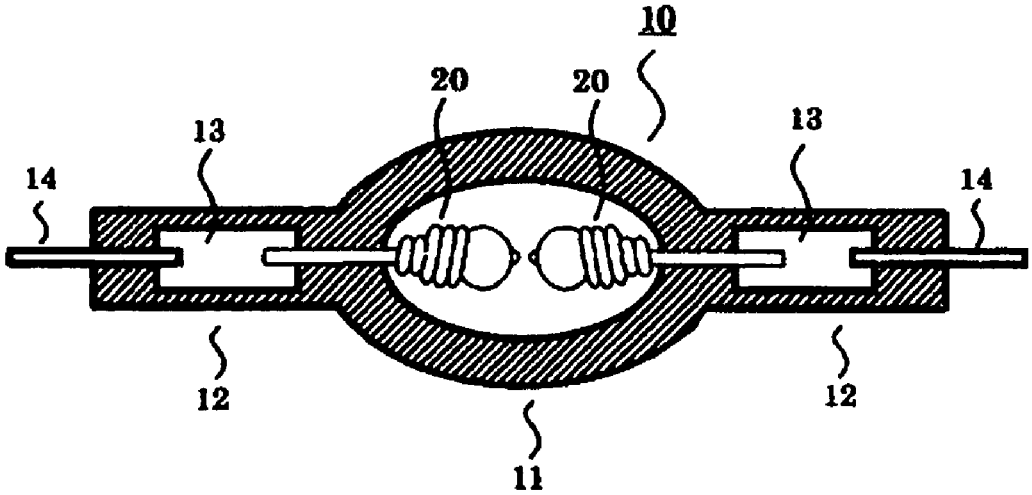
FIG. 1 is a schematic sectional view of the entire arrangement of a discharge lamp.

FIG. 1 shows the overall arrangement of a discharge lamp 10 in accordance with the invention that comprises a silica glass discharge vessel which has an essentially spherical light emitting part 11 and hermetically sealed portions 12. The light emitting part 11 has an emission space in which there is an opposed pair of electrodes 20. The hermetically sealed portions 12 are formed in such a manner that they extend to outward from opposite ends of the light emitting part 11. Normally, an electrically conductive metal foil 13 of molybdenum is hermetically installed in the hermetically sealed portions 12, for example, by a shrink seal. The support rods of the electrodes 20 are each welded to a metal foil 13, and thus, are electrically connected to it. An outer lead 14 is welded to the other end of the metal foil 13 and extends outward from the respective sealed portion 12.

The light emitting part 11 is filled with mercury, argon gas ands halogen.

The mercury is used to obtain the required wavelength of visible radiation, for example, to obtain radiant light with wavelengths of 400 nm to 700 nm, and is added in an amount of at least 0.15 mg/mm$^3$ of mercury. For this added amount, also depending on the temperature conditions, during operation, an extremely high vapor pressure of at least 150 atm is reached. By adding a larger amount of mercury, a discharge lamp can be produced with a high mercury vapor pressure during operation at least 200 or 300 atm. The higher the mercury vapor pressure becomes, the more suitable the light source which can be implemented for a projector device.

For example, 13 kPa of argon gas is added. It is used to improve the ignitability.

Iodine, bromine, chlorine and the like in the form of a compound with mercury or another metal is added as the halogen. The amount of halogen added is selected from the range of $10^{-6}$ μmol/mm$^3$ to $10^{-2}$ μmol/mm$^3$. The main purpose of adding a halogen is to prevent devitrification of the discharge vessel. For an extremely small discharge lamp with an extremely high internal pressure, such as the discharge lamp of the invention, therefore, the so-called halogen cycle is also formed thereby. Oxygen is a substance which is necessary for the effective functioning of the halogen cycle. The optimum amount of oxygen must be exactly added.

The following numerical values of the discharge lamp are shown by way of example:

the maximum outside diameter of the light emitting part is 9.5 mm;

the distance between the electrodes is 1.5 mm;

the internal volume of the arc tube is 75 mm$^3$;

the rated voltage is 80 V and the rated wattage is 150 W.

The lamp is operated using an alternating current.

Such a discharge lamp is installed in a projector device which should be as small as possible. Since, on the one hand, the overall dimensions of the device are extremely small and since, on the other hand, there is a demand for a large amount of light, the thermal effect in the emission space is extremely strict. The value of the wall load of the lamp is 0.8 W/mm$^2$ to 2.0 W/mm$^2$, specifically 1.5 W/mm$^2$.

That the lamp has such a high mercury vapor pressure and such a high value of the wall load leads to the fact that it can offer radiant light with good color rendering if it is installed in a projector device, a presentation apparatus, such as an overhead projector, or in a rear projection television.

In this connection, the discharge lamp is filled with an optimum amount of oxygen at which the halogen cycle can optimally function. In the off state of the lamp or in the glow discharge state, this oxygen is present as a compound (solid aggregate state), such as $WO_x$ or the like. However, this oxygen passes into the gaseous phase in the arc discharge state, i.e., in the state of rated operation.

In accordance with the invention, a production process is provided in which, with respect to preventing devitrification of the discharge vessel and the action of the halogen cycle, a range of numerical values from $10^{-6}$ μmol/mm$^3$ to $10^{-2}$ μmol/mm$^3$ for the amount of added halogen is chosen, and in which, in conjunction with the amount of halogen, the amount of oxygen which in fact contributes to the halogen cycle is exactly established. With the invention, a discharge lamp can be obtained by means of this production process.

Specifically, the discharge lamp 10 is first subjected to a glow discharge, and the relation b/a1 between the emission intensity a1 of argon (Ar) at a wavelength of 668 nm and the emission intensity b of OH radicals at a wavelength of 309 nm is measured. This discharge lamp is likewise subjected to a glow discharge and the relation c/a2 between the emission intensity a2 of argon (Ar) at a wavelength of 668 nm and the emission intensity c of OH radicals at a wavelength of 309 nm is likewise measured. At this point, the difference between the value of b/a1 which was measured first, and the value of c/a2 which was measured afterwards, is determined, i.e., (c/a2−b/a1).

Figure 2:
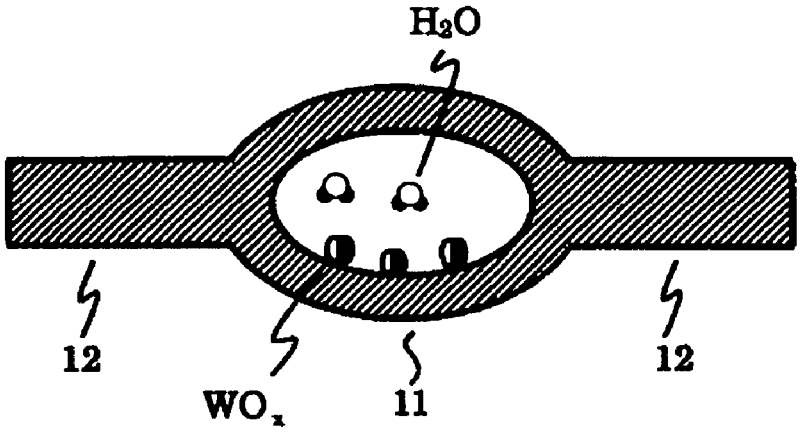
FIGS. 2(*a*) & 2(*b*) each show a schematic of the phenomenon utilized in accordance with the invention.
Figure 2:
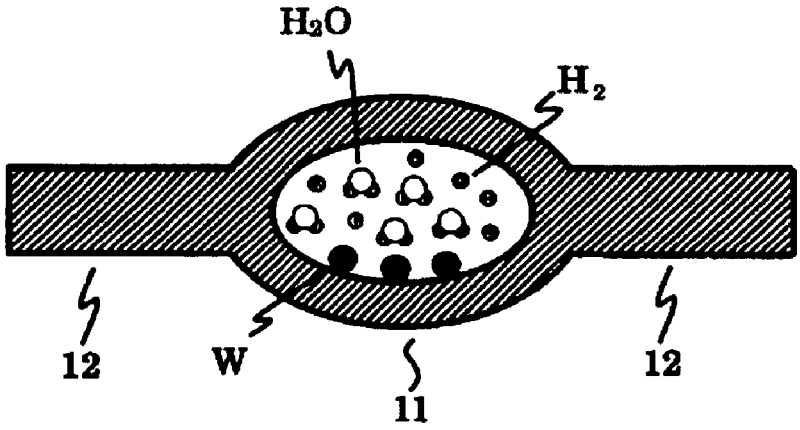

FIGS. 2(*a*) & 2(*b*) each schematically depict the principle of the above described measurement. To facilitate the explanation, advantageously, none of electrodes, metal foils and outer leads are shown. The size and amount of the respective substance and the like are changed for purposes of explanation.

FIG. 2(*a*) shows the state of the oxygen or of water molecules ($H_2O$) in the discharge vessel in a glow discharge before adding the hydrogen. FIG. 2(*b*) shows the state of the oxygen or water molecules ($H_2O$) in a glow discharge after the hydrogen is added. In these schematics, OH radicals, which are emission molecules, are not shown. However, OH radicals had been formed by decomposition of the water molecules ($H_2O$) emitted in the case of a glow discharge. Their emission intensity is proportional to the number of water molecules ($H_2O$).

In FIG. 2(*a*), a large amount of oxygen is bound to tungsten so that compounds $WO_x$ are formed. However, a small amount of oxygen is bound to the hydrogen so that water molecules ($H_2O$) are formed. If a glow discharge is carried out in this state, the spectrum of the OH radicals in this state can be measured.

In FIG. 2(*b*), the added hydrogen in the discharge lamp for the $WO_x$ which contains the bound oxygen causes a reduction action. The oxygen is joined to the hydrogen and forms water molecules ($H_2O$). If a glow discharge is carried out in this state, the spectrum of the OH radicals in this state can be measured.

Therefore, if the ratio of the emission intensity of the OH radicals to argon which was measured in FIG. 2(*a*) is subtracted from the ratio of the emission intensity of the OH radicals to argon which was measured in FIG. 2(*b*), the oxygen which actually contributes to the halogen cycle can be measured.

The hydrogen is supplied to the discharge vessel, for example, by heating the discharge lamp in a hydrogen atmosphere because the hydrogen passes through the silica glass comprising the discharge vessel and afterwards penetrates into the discharge vessel (emission space).

Furthermore, the heating temperature advantageously has the condition that hydrogen can be supplied to the emission space in any amount sufficient for the reaction and the reduction reaction of $WO_x$ or $WO_xBr_y$ is accelerated to an adequate degree. The numerical values are, for example, 600° C. to 1050° C.

Here, advantageously, the amount of hydrogen introduced into the discharge vessel has an optimum range. When the supplied amount is too low, the oxygen bound in the $WO_x$ or $WO_xBr_y$ cannot be adequately reduced and converted into the gaseous phase. When the amount of supply is too great, the discharge voltage becomes too high, by which the glow discharge for measurement is difficult to obtain.

The optimum range of the supplied amount of hydrogen is determined by the heating temperature, the heating time, the inside surface area of the emission space through which the hydrogen passes, and the thickness of the silica glass of the light emitting part. Specifically, by the heating temperature being set to 600° C. to 1050° C., for example, to 950° C., and the heating time being set to 60 minutes to 300 minutes, for example, to 120 minutes, with respect to the size of the bulb which is used in general for this lamp, the oxygen can be converted from the solid aggregate state into the gaseous state to a sufficient degree, and moreover, glow discharge emission can be carried out. The passage of hydrogen through the silica glass is described, for example, in "Abnormal diffusion phenomenon of hydrogen in silica glass" by Moriwaki et al. (J. Illumination Engineering Inst. Japan 61(2) 1977 pp 99-105).

To supply hydrogen, it was allowed to flow into a silica glass tube into which the lamp had been inserted and it was heated in a tubular electric furnace. To specify numerical values, for example: heating lasts 120 minutes, so that 950° C. is reached.

Figure 3:
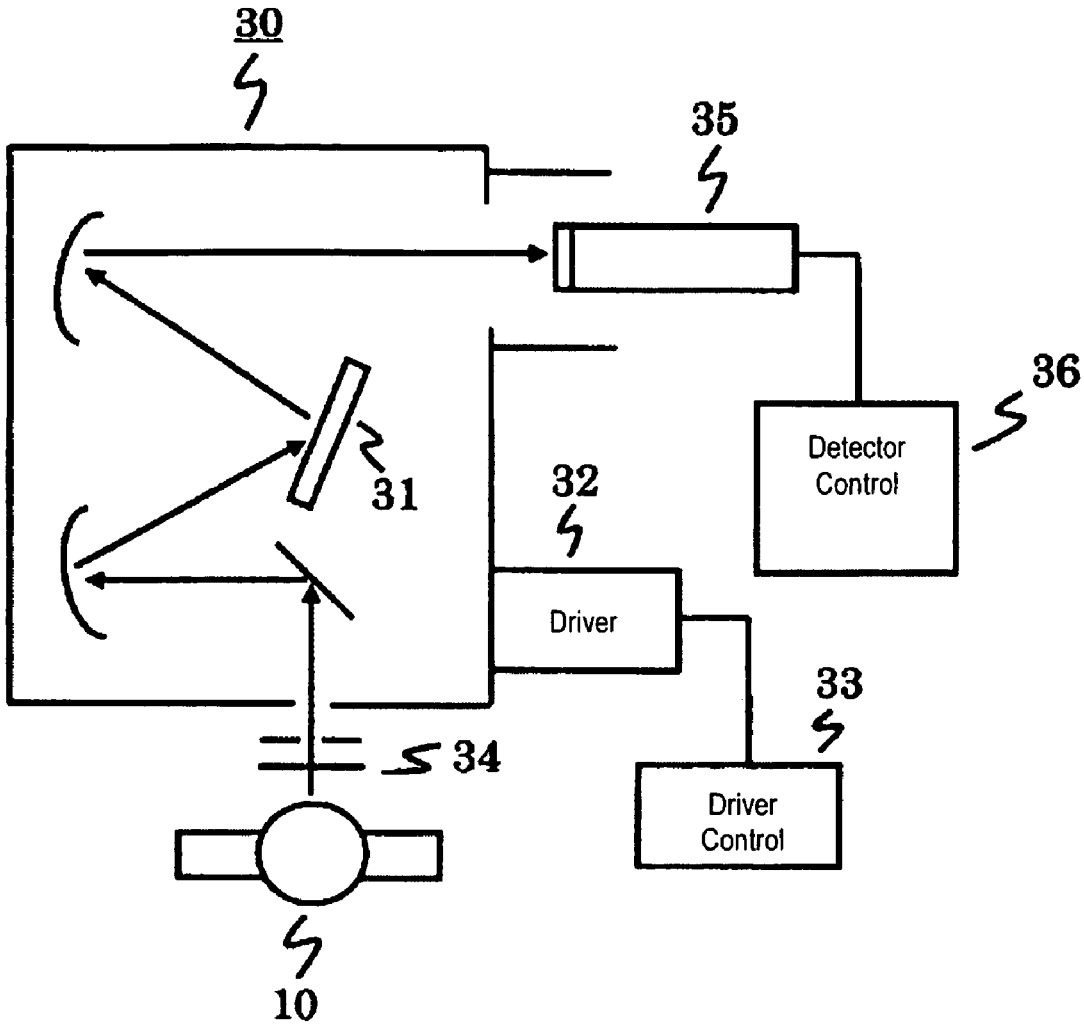
FIG. 3 is a schematic of a spectral measurement device.

The measurement of the emission intensity of the OH radicals for a glow discharge emission is described below. FIG. 3 schematically shows the arrangement of a device for measuring the emission intensity of the discharge lamp. A spectrometer 30 comprises a diffraction grating 31, a driver 32 for turning this diffraction grating 31 and a control device 33 for controlling this driver 32. The light from the discharge lamp 10 is incident in the spectrometer 30 via an incidence slit 34. The light emerging from the spectrometer 30 is determined/measured by a CCD detector 35 and a device 36 for its control.

First, the emission intensity at a wavelength of 309 nm is measured in the state in which the discharge lamp is subjected, to a glow discharge emission. Next, the diffraction grating 31 is turned and the emission intensity at a wavelength of 668 nm is measured. This measurement is taken for the discharge lamp before supply of the hydrogen to the discharge vessel and for the discharge lamp after supply of hydrogen.

For a glow discharge emission, operation takes place, for example, at a rated current of 2.0 A with a direct current of roughly 5 mA. In the case of a discharge which is difficult to stabilize, measurements can also be taken by an outer electrode being installed in the hermetically sealed portion 12 and capacitance coupling operation using an alternating current being carried out with an initial wattage which corresponds to 5 mA.

FIGS. 4(*a*), 4(*b*), 5(*a*), & 5(*b*) each show an example of a spectrum which was measured by the detector 30. FIGS. 4(*a*) & 4(*b*) show the spectrum before supply of the hydrogen, FIG. 4(*a*) showing the vicinity of the OH radicals at a wavelength of 309 nm and FIG. 4(*b*) showing the vicinity of the argon at a wavelength of 668 nm. FIGS. 5(*a*) & 5(*b*) show the spectrum after hydrogen has been supplied, FIG. 5(*a*) showing the vicinity of the OH radicals at a wavelength of 309 nm and FIG. 4(*b*) showing the vicinity of the argon at a wavelength of 668 nm. The respective y axis plots the intensity of the spectrum (counts), while the x axis plots the wavelength (nm). The term "intensity" of the y-axis is defined as the numerical value of the amount of light received by the CCD which is plotted using "counts." It is used to measure the relative values between the wavelengths.

The computation of the ratio of the emission intensity of the OH radicals to the emission intensity of argon is described below using one example. In FIGS. 4(*a*) & 4(*b*), the intensity of a wavelength of 309 nm is 3414, the background is 3100 and emission by the OH radicals is 314 (=3414−3100). Furthermore, the intensity of a wavelength of 668 nm is 9588, the background is 100 and emission by argon is 9488 (=9588−100). In FIGS. 5(*a*) & 5(*b*), the intensity of a wavelength of 309 nm is 75453, the background is 31000 and emission by the OH radicals is 44453 (=75453−31000). Furthermore, in this connection, the intensity of a wavelength of 668 nm is 41117, the background is 400 and emission by the argon is 40717 (=41117−400).

The term "background" is defined as emission except by the OH radicals. It means, for example, emissions of argon, mercury and silica glass in the case of a wavelength of 309 nm. To determine emission by the OH radicals, this background must be subtracted. This is the procedure in the case of a wavelength of 668 nm.

As a result, the ratio of the emission intensity of OH radicals before hydrogen is supplied to the emission intensity of argon is 0.033 (=314/9488) and the ratio of the emission intensity of OH radicals after supplying of hydrogen to the emission intensity of argon is 1.092 (=44453/40717).

The numerical value data acquired by the detector are influenced by the optical system within the spectrometer and by the wavelength dependency of the detector, and therefore, have different properties than the light emitted by the lamp. As a result, it is necessary to multiply the above described measured value by correction values and to compensate with respect to the intensity of the light emitted by the lamp. The correction values are determined by the detector and by the spectrometer. The data required for correction are normally clearly shown per spectrometer and detector. Specifically, there are correction values using the yield of the light of the diffraction grating which enters as a result of refraction, correction values of the sensitivity of the CCD and correction values in the case of an arrangement of a sharp-cut filter, such as, for example, a parallel capacitor, in front of the slot of the spectrophotometer for preventing the influence of second harmonics.

Assuming a correction value of 0.4 with consideration of all the above described circumstances, the ratio of the emission intensity of OH radicals before supplying of hydrogen to the emission intensity of argon is 0.0132 (=0.033×0.4). This numerical value corresponds to the intensity ratio of the light emitted by the lamp, i.e., b/a1 in accordance with the invention. Furthermore, the ratio of the emission intensity of OH radicals after supply of hydrogen to the emission intensity of argon is 0.4368 (=1.092×0.4). This numerical value corresponds to the intensity ratio of the light emitted by the lamp, i.e., c/a2 in accordance with the invention. The difference between the two intensity ratios is therefore 0.4236 (=0.4368−0.0132).

The ratio of the emission intensity of OH radicals to Ar was multiplied by correction values above. But likewise for the respective measured value (314 for OH radicals and 9488 for argon in FIGS. 4(*a*) & 4(*b*)), the corrected value can be considered, and afterwards, the ratio of the two to one another can be computed.

The reason for comparison of the emission intensity of OH radicals to the emission intensity of Ar when measuring the number of water molecules existing in the discharge space is that the emission intensity of the OH radicals in the emission space is greatly influenced by the operating conditions and the ambient conditions, and therefore, it cannot be measured as an absolute value. For example, if the same discharge lamp is operated, the mercury vapor pressure changes due to the difference of the ambient temperature, by which the energy which contributes substantially to the emission of the OH radicals changes. As a result, the absolute value of the emission spectrum of the OH radicals differs from it. Even if the operating states of the lamp (installation site and length of operation) differ only slightly, the absolute values of the emission spectra of the OH radicals differ. Therefore, the emission spectrum of Ar is measured at the same time and the number of OH radicals is determined using the ratio of their emission intensity to the emission intensity of argon.

The reason for using argon as the comparison substance is that it must be added anyway as a buffer gas to start operation and that it does not have such a great change of emission intensity due to temperature as does mercury.

When the emission intensity of the OH radicals and the emission intensity of Ar are measured, it is desirable to measure the emission intensity of the OH radicals beforehand. In the case of repeated measurement, it is desirable to turn off the discharge lamp for each measurement and to measure within two seconds after starting operation. This is because the intensity of the emission spectrum of the OH radicals is damped in the course of operation. Specifically, first the discharge lamp is operated, within two seconds the emission intensity of the OH radicals is measured, and afterwards the emission intensity of Ar is measured. Next, the discharge lamp is turned off once, restarted, then the emission intensity of the OH radicals is measured within two seconds, and afterwards, the emission intensity of Ar is measured. This sequence is repeated several times. However, it is desirable, after operation has been started once, in the next measurement, to carry out rated operation (arc discharge) for about five minutes in order to reset the conditions of the gas components within the lamp.

In this way, in the process of the invention for producing a discharge lamp, first a glow discharge emission is carried out, and the ratio of the emission intensity of the OH radicals which have a gaseous phase state to the emission intensity of Ar is measured. Next, hydrogen is supplied to the discharge lamp and again the ratio of the emission intensity of the OH radicals which have undergone glow discharge emission and have been shifted into the gaseous phase to the emission intensity of Ar is measured. Furthermore, in accordance with the invention, the ratio of the emission intensity of OH radicals to the emission intensity of Ar which was measured a second time is subtracted from the ratio of the emission intensity of OH radicals to the emission intensity of Ar which was measured a first time, by which the oxygen is measured exactly which had had a solid aggregate state the first time as a compound, but which in the second measurement is bound to hydrogen, yielded water molecules and was shifted into the gaseous phase state, i.e., the oxygen which can contribute authentically to the halogen cycle.

The invention is characterized in that the difference between the ratio of the emission intensity before supply of hydrogen (b/a1) and the ratio of the emission intensity after hydrogen is supplied (c/a2), i.e., ((c/a2)−(b/a1)) is within a range from 0.001 to 15.

The expression "halogen cycle" is defined as using the mechanism that metallic substances which vaporize and spray off the electrodes form a compound with oxygen and halogen in the emission space and return again to the electrodes, so that the service life of the discharge lamp is prolonged.

In the case in which ((c/a2)−(b/a1)) is less than 0.001, the amount of oxygen which contributes to the halogen cycle is low. Therefore, the halogen cycle cannot proceed satisfactorily. As a result blackening occurs within a short time in the arc tube.

In the case in which ((c/a2)−(b/a1)) is greater than 15, the halogen cycle is too strongly activated, by which considerable electrode deformation is caused. In the case of a shortened distance between the electrodes the lamp voltage is reduced; this leads to destruction of the operation ballast. Furthermore, tungsten is transported from the electrode tip to the back end of the electrode, by which tungsten is deposited on the back end of the electrode. If this deposition continues, tungsten travels to the inside of the arc tube; this leads to destruction of the arc tube. The above described phenomenon clearly occurs especially in a lamp for a projector device in which the distance between the electrodes is roughly 1.5 mm and also the outside diameter of the arc tube is less than or equal to 10 mm.

Furthermore, it is desirable for (b/a1) to be less than 0.05. The reason for this is that, in a lamp with high (b/a1) in the initial stage of operation, milky opacification is generated and the illuminance in the initial stage is greatly reduced. During production, water penetrates into the discharge vessel; hydrogen from the water joins with the $SiO_2$ of the silica glass of the discharge vessel and forms SiO which vaporizes. SiO is joined again with the oxygen in the gaseous phase and is deposited again as $SiO_2$ on the inside of the discharge vessel. However, it is not securely joined to the glass of the inside wall of the discharge vessel, rather it is deposited on the inside wall in the form of cristobalite particles; this causes milky opacification.

When a large number of OH radicals (i.e., water molecules) are present when operation starts, the ignition voltage increases and the disadvantages of an enlargement of the device and a safety problem occur.

Besides hydrogen, also carbon (C) and the like are present in the discharge vessel. Therefore, the oxygen which is in the gaseous phase is present not only in the form of water molecules, but also as $CO_x$ or the like. This $CO_x$ is also present unchanged as $CO_x$ in the case of hydrogen being supplied. This means that even when carbon (C) penetrates into the discharge vessel and $CO_x$ and the like are present, the amount of hydrogen does not change before and after supply. There is no effect on the determination process of the invention.

As was already described above, in accordance with the invention, more or less, the same state as in the arc discharge in the sense of the oxygen state is produced by supply of hydrogen, in this state, the glow discharge emission is carried out, and thus, the amount of oxygen is measured without any influence by mercury emission. The feature of the invention lies in that the OH radicals (i.e., water molecules) which are increased again by the supply of hydrogen correspond exactly to the oxygen which in fact contributes to the halogen cycle.

By the production process of the invention ((c/a2)−(b/a1)) is measured, by which it can be confirmed that this discharge lamp contains a suitable amount of oxygen. In this sense, the invention may relate to a process for inspection of a discharge lamp. By eliminating the hydrogen from this discharge lamp, however, the lamp can be returned to the state of a commercial discharge lamp. Therefore, in the sense of taking this measurement during the process of producing the discharge lamp, the invention can be called as a process for producing a discharge lamp.

As a process for eliminating the hydrogen, for example, vacuum heating of the entire lamp or a process can be imagined in which, by applying an electrical field between the outside surface of the light emitting part and the electrically conductive components located inside (electrodes, Mo foils), the hydrogen in the discharge space is eliminated, as is disclosed in International Patent Application Publication WO 2004/084253 A.

Generally, there are many cases in which lamps with the same standard and the same specification are continuously produced or produced in batches for these discharge lamps. This means that if the values of ((c/a2)−(b/a1)) of the discharge lamps fabricated with the same specification are essentially identical to one another and if ((c/a2)−(b/a1)) of a single discharge lamp is within the range from 0.001 to 15, other discharge lamps which are produced in the same process can also be designated as having the same properties.

Therefore, in general, this measurement can only be taken for certain discharge lamps and this measurement result can be used representatively for other discharge lamps. This is equivalent to a destruction resistance test by random tests.

A process for monitoring the amount of oxygen contained in the discharge lamp can be a process in which, in the course of hermetic sealing, oxygen is mixed with the argon to be added, and in which the amount of oxygen is controlled.

FIGS. 6(*a*) to 6(*h*) schematically show the operations for producing the discharge lamp which progress from (a) to (h). In FIG. 6(*a*), a mount is inserted into one of the hermetically sealed portions, in which mount electrodes, metal foils and outer leads are formed integrally with one another. This hermetically sealed portion is sealed in FIG. 6(*b*). In FIG. 6(*c*) mercury and the halogen compound are added to the light emitting part, and a second mount is inserted in the other hermetically sealed portion. In FIG. 6(*d*), the inside of the light emitting part is evacuated. In FIG. 6(*e*), the light emitting part is filled with a gas mixture of argon and oxygen. In FIG. 6(*f*), the other hermetically sealed portion is closed. In FIG. 6(*g*), one of the hermetically sealed portions is sealed, for example, by a shrink seal. In FIG. 6(*h*), the other hermetically sealed portion is sealed, for example, by a shrink seal. In a subsequent production step (not shown), the closed portion that extends outward from the hermetically sealed portion would normally be removed to expose the outer lead 14.

In the operation according to FIG. 6(*e*), a gas mixture of argon and oxygen is added. By controlling this mixing ratio the amount of oxygen can be controlled. For example, 99.9% argon and 0.1% oxygen yield a total of 13 kPa and 99% argon and 1% oxygen yield a total of 13 kPa.

Control is exercised by the following measure:

In the case of a small value of ((c/a2)−(b/a1)), the oxygen ratio in the operation (e) is increased. In the case of a large value thereof, the oxygen ratio is reduced.

In this case, the hydrogen can be eliminated from the measured discharge lamp, and thus, this lamp can also be completed. However, in the sense of a simplification of the entire production process, this discharge lamp can be destroyed and only in the production of the next discharge lamp can the above described control according to operation (e) be carried out.

A test with respect to the numerical value range of ((c/a2)−(b/a1)) is described below.

Twenty four different discharge lamps (lamp 1 to lamp 24) with the same arrangement as in FIG. 1 were produced in pairs for a total of 48 lamps. The amount of oxygen added and the amount of the halogen added differed from lamp to lamp, while other conditions, such as the discharge vessel, the electrodes, other substances to be added, electrical properties and the like were made identical to one another. Specifically, the discharge lamp was made of silica glass discharge vessel having a total length of 60 mm, an outside diameter of the light emitting part of 9.4 mm, an inside diameter of 4 mm and an inside volume of the emission space of roughly 60 $mm^3$. The length of the hermetically sealed portion was 20 mm and the outside diameter thereof was 5 mm. For vacuum degassing of the discharge vessel (silica glass) the treatment pressure was $5\times10^{-5}$ Pa, the treatment temperature was 1150° C. and the length of treatment was 40 hours. The two electrodes were made of tungsten. The distance between the electrodes was 1.2 mm. The electrodes were heat treated at a treatment pressure of $8\times10^{-5}$ Pa, a treatment temperature of 2200° C. and a treatment duration of 30 hours. The amount of mercury added was roughly 13 mg for all lamps (corresponds to roughly 0.22 $mg/mm^3$).

Three types of lamps of 16 lamps each were produced, the amount of bromine added being $2\times10^{-4}$ $\mu mol/mm^3$, $1\times10^{-3}$ $\mu mol/mm^3$ or $7\times10^{-3}$ $\mu mol/mm^3$. Specifically, lamps 1, 4, 7, 10, 13, 16, 19, and 22 with $2\times10^{-4}$ $\mu mol/mm^3$, lamps 2, 5, 8, 11, 14, 17, 20 and 23 with $1\times10^{-3}$ $\mu mol/mm^3$ and lamps 3, 6, 9, 12, 15, 18, 21, and 24 with $7\times10^{-3}$ $\mu mol/mm^3$ were produced, for each lamp pair, for example two of lamps 1, two of lamps 2, etc. having been produced.

The Ar—$O_2$ mixture was 13.3 kPa. There were seven different $O_2$ concentrations with respect to Ar, specifically 0.005%, 0.01%, 0.1%, 0.3%, 0.5%, 1% or 3%. Specifically, the lamps 1 to 3 have 0.005%, the lamps 4 to 6 have 0.01%, the lamps 7 to 9 have 0.1%, the lamps 10 to 12 have 0.3%, the lamps 13 to 15 have 0.5%, the lamps 16 to 18 have 1%, the lamps 19 to 21 have 3% and the lamps 20 to 24 have 0.3%.

As the rated values, these discharge lamps have a rated voltage of 70 V, a lamp current of 1.7 A and a lamp wattage of 120 W.

For each of these 24 discharge lamp pairs, the emission intensity was measured for one and the service life characteristics were tested for the other.

Heat treatment in a hydrogen atmosphere was carried out at 950° C. for a period of 120 minutes.

For measuring the emission intensity, a direct current of roughly 5 mA was supplied to each lamp, and thus, a glow discharge emission was carried out. Using the spectral measurement device shown in FIG. 3, the emission intensity at a wavelength of 668 nm and the emission intensity at a wavelength of 309 nm were measured, and the ratio (b/a1) was computed with consideration of the correction value in the above described manner.

Next, hydrogen was supplied to each discharge lamp, and likewise the emission intensity at a wavelength of 668 nm and the emission intensity at a wavelength of 309 nm were measured and the ratio (c/a2) was computed likewise with consideration of the correction value. Based on this computed value (c/a2)−(b/a1) was determined.

A spectrometer "g-500III" produced by Nikon and a CCD detector of the electron cooling type "DV-420" produced by Andor Technology were used. The slit width of the incidence slit 25 was 50 μm, the notch number of the diffraction grating 31 was 1200 lines/mm and the scattering of the reciprocal value at a wavelength of 500 nm was 1.5 nm/mm. The resolution of the spectral measurement device which has these values is a full width at half maximum (=FWHM) of 0.5 nm to 0.8 nm. In the case of a low resolution, there are cases in which the peak cannot be adequately determined. Therefore, it is necessary to use a spectral measurement device with a resolution of at least greater than 0.10 nm. The correction value of the diffraction grating with respect to the measured value of OH 309 nm/Ar 668 nm is 0.3154, the correction value of the CCD sensitivity is 1.548 and the correction value of the sharp cut filter is 0.9217. The ratio of the emission intensity of the lamp can be determined by multiplying them.

Each discharge lamp was operated for 10000 hours at a time for the service life characteristic, and a relative value was measured, the initial illuminance having been considered to be 100.

FIG. 7 shows the result of the above described tests. In this connection, the values b/a1, c/a1, c/a2−b/a1 of the lamps 1 to 24 and the relative illuminance for each length of operation are shown. For the relative illuminance, values are shown for operation of 100 hours, 300 hours, 500 hours, 1000 hours, 3000 hours, 5000 hours and 10000 hours.

For the service life, generally, the time for which 50% of the initial illuminance was maintained was considered as representing durability. The lamps which maintained 70% of the initial illuminance even after operating for 10000 hours can be considered good.

As a result, the lamps 4 to 18 are good, while the lamps 1 to 3 and the lamps 19 to 24 are not good. The values of c/a2−b/a1 of the lamps 4 to 18 are 0.001 (lamp 4) to 15.0010 (lamp 18). With consideration of measurement errors and the like, it can be derived that the range from 0.001 to 15.0 is optimum.

The values of c/a2−b/a1 of the lamps 22 to 24 are within the range from 0.001 to 15.0. Their service life characteristic however is not advantageous. This is because the values of b/a1 are greater than 0.05. This shows that the inside wall of the discharge vessel was prematurely opacified in a milky manner.

As was described above, the invention relates to a process for producing a discharge lamp in which a pair of electrodes are disposed in a silica glass discharge vessel and the discharge vessel is filled with at least 0.15 mg/mm$^3$ of mercury, argon (Ar), and halogen characterized by the following process steps:

the relation b/a1 between the emission intensity a1 of argon (Ar) at a wavelength of 668 nm and the emission intensity b of OH radicals at a wavelength of 309 nm is measured in the state of a glow discharge of the above described discharge lamp;

hydrogen is added to the discharge vessel of this discharge lamp;

the relation c/a2 between the emission intensity a2 of argon (Ar) at a wavelength of 668 nm and the emission intensity c of OH radicals at a wavelength of 309 nm is likewise measured in the state of a glow discharge of this discharge lamp; and the difference between b/a1 and c/a2, i.e., (c/a2−b/a1), is fixed to within the range of 0.001 to 15.

Furthermore, the invention is characterized by a discharge lamp which is obtained by this process.

Using this arrangement, the amount of oxygen which is present in the OFF state or for a glow discharge in the solid aggregate state such as in the form of tungsten oxide ($WO_x$) or tungsten bromoxide ($WO_xBr_y$) can be exactly metered, and by adding this oxygen the halogen cycle can be allowed to proceed effectively, and thus, a discharge lamp with a long service life can be devised.

The above described embodiment was described based on a discharge lamp using an alternating current. However, of course, the invention can also be used for a discharge lamp using a direct current.

What is claimed is:

1. Process for producing a discharge lamp having a silica glass discharge vessel in which a pair of electrodes is disposed and which is filled with at least 0.15 mg/mm$^3$ of mercury, argon (Ar), and halogen, comprising the steps of:

measuring the relation b/a1 between the emission intensity a1 of argon (Ar) at a wavelength of 668 nm and the emission intensity b of OH radicals at a wavelength of 309 nm in a state of glow discharge of the discharge lamp;

supplying hydrogen into the discharge vessel of the discharge lamp;

measuring the relation c/a2 between the emission intensity a2 of argon (Ar) at a wavelength of 668 nm and the emission intensity c of OH radicals at a wavelength of 309 nm in the state of glow discharge of the discharge lamp; and fixing the difference c/a2−b/a1 at a value in the range of 0.001 to 15.

2. Process as claimed in claim 1, comprising the further step of introducing oxygen into the discharge vessel in an amount such that the value of c/a2−b/a1 lies within the given range.

3. Process as claimed in claim 2, wherein said introducing of oxygen into the discharge vessel is performed using a mixture of oxygen with argon.

4. Process as claimed in claim 1, wherein the value of b/a1 is set to less than 0.05.

5. Process as claimed in claim 1, wherein the supplied hydrogen is removed from the discharge vessel after completion of the measuring steps.

6. Discharge lamp, comprising a discharge vessel in which a pair of electrodes is disposed and which is filled with at least 0.15 mg/mm$^3$ of mercury, argon (Ar), and halogen, and wherein the difference c/a2−b/a1 has a value in the range of 0.001 to 15 where b/a1 is the relation between the emission intensity a1 of argon (Ar) at a wavelength of 668 nm and the emission intensity b of OH radicals at a wavelength of 309 nm in the case of a glow discharge of the discharge lamp without hydrogen having been added to the discharge vessel and c/a2 is the relation between the emission intensity a2 of argon (Ar) at a wavelength of 668 nm and the emission intensity c of OH radicals at a wavelength of 309 nm in the case of glow discharge of the discharge lamp after adding hydrogen to the discharge vessel of the discharge lamp.

7. Discharge lamp as claimed in claim 6, wherein b/a1 is less than 0.05.

* * * * *